United States Patent [19]

Nilsson et al.

[11] Patent Number: 5,030,165

[45] Date of Patent: Jul. 9, 1991

[54] COIN ASSORTING DEVICE

[75] Inventors: Bengt G. Nilsson, Oxie; Bengt G. Lindahl, Lund, both of Sweden

[73] Assignee: Scan Coin AB, Malmo, Sweden

[21] Appl. No.: 539,919

[22] Filed: Jun. 18, 1990

Related U.S. Application Data

[62] Division of Ser. No. 246,299, filed as PCT SE87/00102 on Mar. 4, 1987, published as WO87/05729 on Sep. 24, 1987, Pat. no. 4,943,257.

[30] Foreign Application Priority Data

Mar. 11, 1986 [SE] Sweden ..... 8601117

[51] Int. Cl.[5] ..... G07D 1/00

[52] U.S. Cl. ..... 453/9; 453/49; 453/57; 194/334

[58] Field of Search ..... 453/3, 9, 12, 13, 39, 453/40, 49, 57; 209/666, 707; 194/334, 335, 338

[56] References Cited

U.S. PATENT DOCUMENTS

| | | | |
|---|---|---|---|
| 1,927,265 | 9/1933 | Hume | 453/13 |
| 2,881,775 | 4/1959 | Miller | 453/12 |
| 3,047,124 | 7/1962 | Wexler | 453/49 X |
| 3,242,931 | 3/1966 | Wandrey | 453/49 X |
| 3,583,410 | 6/1971 | Bayha et al. | 453/49 X |
| 3,971,393 | 7/1976 | Akai et al. | 453/49 X |
| 4,202,362 | 5/1980 | Kashio | 453/49 X |
| 4,398,550 | 8/1983 | Shireman | 453/57 X |
| 4,798,558 | 1/1989 | Bellis | 453/57 X |

FOREIGN PATENT DOCUMENTS 761390 3/1934 France .

*Primary Examiner*—David A. Bucci
*Assistant Examiner*—Scott L. Lowe
*Attorney, Agent, or Firm*—Michael B. Lasky

[57] ABSTRACT

Coin assorting device having a disc (12) mounted for rotation on a bottom plate (10) to pass below a coin supply tube (19). The rotatable disc includes two pairs of recesses (16) for receiving a coin in each recess, the bottom plate having a discharge opening (20) for coins the diameter of which is less than a predetermined maximum diameter of the coins supplied. The discharge opening (20) extends beneath the mouth of the coin supply tube (19) and is shaped with an upper chamfered edge (24). Opposite sides of the wings (14) of the rotatable disc (12) are shaped in the form of blunt edges having a thickness which substantially corresponds to the thickness of the thinnest occurring coin. Circuitry is associated with the rotatable disc (12) for momentarily reversing the rotational movement of the disc when a coin jamming is sensed.

1 Claim, 2 Drawing Sheets

COIN ASSORTING DEVICE

Figure 1:
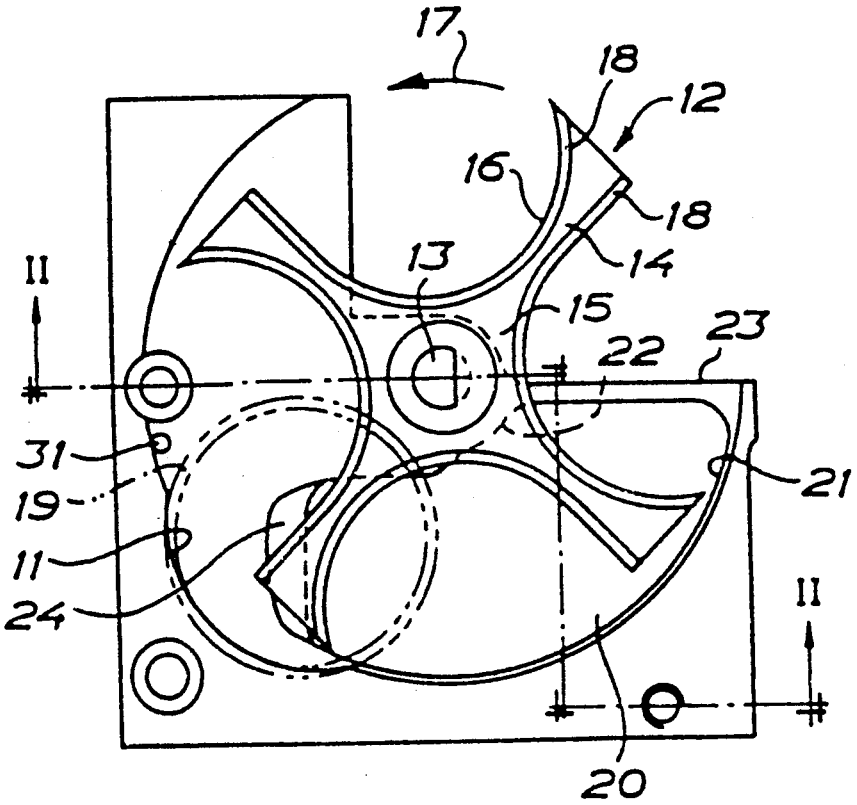

This is a division of application Ser. No. 246,299, filed as PCT SE87/00102 on Mar. 4, 1987, published as WO87/05729 on Sep. 24, 1987, now U.S. Pat. No. 4,943,257.

The invention relates to a coin assorting device comprising a disc mounted for rotation on a bottom plate to pass, when rotating, below a coin supply tube and forming recesses arranged in pairs diametrically opposite each other, for receiving a coin from the coin supply tube in each recess, said bottom plate having a discharge opening for coins the diameter of which is less than a predetermined maximum diameter of the coins supplied.

Coin assorting means of this type are used in coin assorting machines for a so called second sorting of the coins. Then, the coins of an unassorted coin body are first subject to a first sortening, wherein the coins one after the other are allowed to roll along a sloping path and in dependence of the size of the coin diameter are diverted therefrom in one of a number of stations, where the coins are allowed to fall into coin tubes, the inside diameter of which is adjusted to the diameter of the coins to be received therein. In the coin tube the coins will form a pile which accordingly should include only coins of one and the same diameter. It is completely precluded and it is a technical impossibility that a coin the diameter of which is larger than the diameter of coins to be collected in the tube, could be included in the coin pile. However, it cannot be precluded that a coin or two having a smaller diameter appear in the coin pile from time to time. When-the coins are diverted from the sloping path it may in fact happen that a coin which is diverted at the proper station brings along a smaller coin running in parallel with said coin, when falling down into the coin tube. Even if such anomalies in sortening the coins are rectified by said second sortening applied for many years, it nevertheless happens from time to time that a small parallel-running coin which has fallen down into the coin tube, causes cramping between the coins and the lower edge of the coin tube. There is a particular risk of such cramping in such cases when the diameter and thickness of said incorrect coin are small. When such cramping has occurred in coin assorting devices of the kind previously known, it may be necessary to stop the coin assorting machine, disassemble the coin tube and then manually remove the coin which has caused the cramping.

A main object of the present invention thus is to reduce, in coin assorting devices of the kind mentioned initially, the risk that interruption in the operation caused by cramping should happen. In case cramping caused by an incorrect small coin nevertheless should occur, still another object of the invention is to remove this interruption of the operation by automatically during a short sequence reversing the rotational movement of the rotatable disc and by striking action against the coin eliminate the cramping and then automatically revert to the initial rotational direction at the same time discharging coins.

According to the invention the objects mentioned above are achieved by designing the coin assorting device in accordance with the characteristic features specified in the appended claims.

Figure 2:
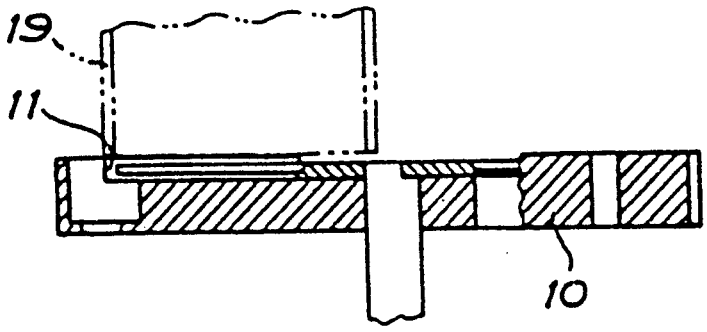
Figure 3:
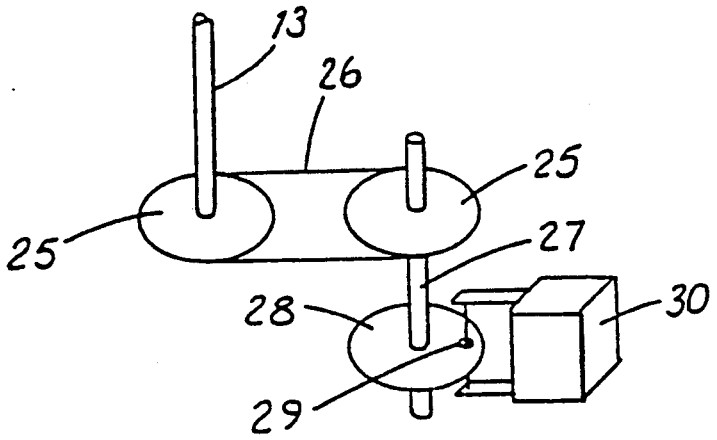
Figure 4:
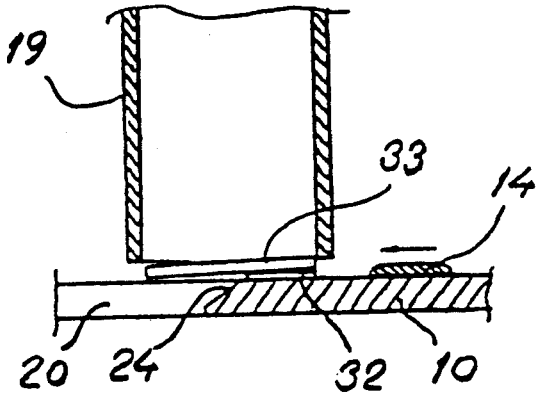
Figure 5:
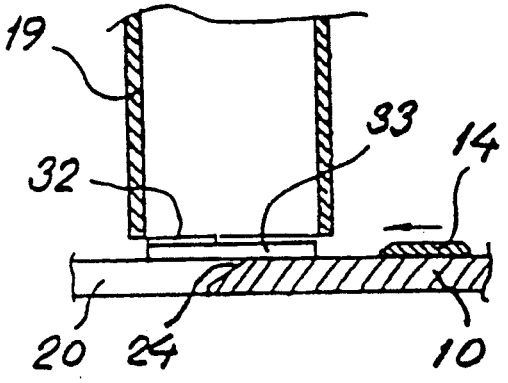

In order to explain in more detail the invention an embodiment thereof will be described with reference to the accompanying drawings, in which FIG. 1 is a plan view of the coin assorting device, FIG. 2 is a cross-sectional view taken along the broken dot-and-dash line II—II in FIG. 1, FIG. 3 illustrates very schematically an arrangement for automatically, during a short sequence, causing the rotational disc to rotate in the opposite direction in order to eliminate cramping that has occurred, and FIGS. 4 and 5 illustrate diagrammatically two situations in which cramping may occur.

The coin assorting device comprises a bottom plate 10, which should be fixedly mounted in a coin assorting machine. This bottom plate has on the upper side thereof a milled recess 11, with a flat bottom in which a disc 12 is rotatably mounted by means of a drive shaft 13. The rotatable disc 12 has four wings 14 which project from a hub 15 and are separated from each other by means of substantially semicircular recesses 16. The intended rotational direction of the disc is indicated by an arrow 17, and the edges of the recesses 16 are provided with a chamfer 18, so that each wing 14 is chamfered on the front edge thereof, as seen in the rotational direction, as well as on the opposite edge.

A coin tube 19 connects to the upper side of the disc 12 rotatable in the bottom plate 10, said tube being arranged to receive coins from a device for a first sortening. Thus, when the disc 12 is rotating, it passes below the lower end of the coin tube 19. The disc 12 should preferably have a maximum thickness which equals the thickness of the coins to be received by the coin tube 19, such that the disc when rotating past the lower end of the coin tube 19 will bring along the coin which at each occasion is the lowermost coin of a coin pile in the coin tube, when a recess 16 passes the coin tube 19. The chamfer 18 on the front and rear edges of the wings 14 is shaped to form a blunt edge, said blunt edge preferably having a height which substantially corresponds to the thickness of the smallest coin. In the milled recess 11 having a flat bottom there is formed a discharge opening 20, which is defined by two circular edges 21 and 22, the center of which is located on the rotational axis of the disc 12. These two edges are radially spaced from each other a distance which is somewhat less than the diameter of the coins to be received by the coin tube 19, such that these coins resting on narrow portions at each of the edges 21 and 22 can pass the discharge opening 20 when they are brought along by the rotatable disc 12, then to be supplied to a suitable collection means for these coins at an edge 23 of the bottom plate. A coin, if any, having less diameter than the intended diameter of the coins in the coin pile received by the coin tube 19, will be discharged, however, by falling down through the opening 20 in order to be collected at another location. In accordance with the present invention the opening 20 in the bottom plate 10 extends beneath the mouth of the coin tube 19. The dimensions of the portion of the opening 20 which extends beneath the lower end of the coin tube 19 are preferable such that the distance between opposite limiting borders of the opening 20 does not coincide with the diameter of any known coin which might be present in the coin tube. The major portion of the limiting border of the opening 20 which extends beneath the coin tube is further provided with a chamfer 24, which further facilitates for incorrect coins to fall down into the through opening 20 az an early stage.

FIG. 3 schematically illustrates an arrangement for automatically, when cramping between two coins and the lower edge of the coin tube has occurred, induce a reversed rotational direction of the rotatable disc during a short sequence corresponding to half a revolution, in order to loosen the cramping grip of the coins, and then immediately bring the rotatable disc to rotate in the initial rotational direction at the same time discharging coins. A transmission sheave 25 for a transmission belt, e.g. an O-ring 26, is mounted on the downwardly projecting portion of the drive shaft 13 of the rotatable disc 12. A shaft 27 which also is provided with a corresponding transmission sheave 25, is rotatably mounted in bearings in parallel with the drive shaft 13. Said two transmission sheaves 25 form together with the O-ring 26 a transmission for driving the shaft 27 for rotation synchronously with the drive shaft 13. Supported by shaft 27 is also a thin disc 28 provided with a peripheral through opening 29. Mounted close to the disc 28 is an optical fork-shaped sensor 30, the branches of said fork being disposed one above and the other beneath the disc 28. One of the branches of the fork is provided with means for emitting a light beam vertically through the opening 29, and the opposite branch of the fork is provided with means for registering said light beam. When the rotatable disc 12 rotates, one signal for each revolution is obtained. If an expected signal fails to come i.e. when the rotation of the rotatable disc 12 is prevented e.g. by cramping, the optical sensor 30 is adapted to trigger a control signal to the drive motor for said disc 12 for reversing the rotational direction during a predetermined period which approximately corresponds to half a revolution, and then again to reverse the rotational direction back to normal direction. When cramping has occurred between two coins and the lower edge of the coin tube 19, the rotatable disc 12 is thus made to rotate in the opposite direction, the rear edge of the wing 14 then by striking action against the coin drives the coin back thus changing the relative positions of the coins so that when the rotatable disc again starts to rotate in its normal rotational direction, the wing 14 manages to discharge the lowermost coin. To prevent that the coin by backwards striking movement is displaced too long a distance backwards, a pin 31 is fixed to the bottom plate, said pin limiting the backwards movement of the coin.

FIGS. 4 and 5 illustrate two different situations involving a certain risk of cramping of coins against the lower edge of the coin tube 19.

FIG. 4 illustrates a case in which an incorrectly sorted small coin 32 has landed on the feeding plate 10 beneath a correct coin 33. Usually this situation does not lead to any major problem since the chamfered front edge of the wing 14 when said wing rotates only brings along the small coin 32, which after forwarding falls down through the opening 20, after which the following wing 14 brings along the coin 33. It may happen, however, that both coins 32 and 33 are displaced in a direction forwards and then are cramped below the coin tube 19. If this happens, the rotatable disc is made to reverse in the manner described above, resulting in that the rear chamfered edge of the wing 14 strikes against the front edge of the coin 33 thereby displacing said coin in the rearward direction so that the relative position between coins 32 and 33 is changed. At the following feeding action by means of wing 14, only coin 32 is fed to the opening 20, the following wing 14 then discharging the correct coin 33.

In the situation schematically illustrated in FIG. 5 the incorrectly sorted small coin 32 is situated on top of the correct coin 33, which rests on the bottom plate 10. In normal cases this situation does not lead to any problems either. The wing 14 thus feeds only the correct coin 33, the incorrect coin 32 then falling down into the opening 20. However, if cramping should occur against the lower edge of the coin tube 19, the reversing action described above will occur, resulting in a relative displacement between the coins 32 and 33, coin 32 then falling down into the opening 20, after which the correct coin 33 is fed by means of the wing 14.

I claim:

1. Coin assorting device comprising a disc mounted for rotation on a bottom plate, having a normal rotational direction and rotating below a coin supply tube for coins stacked therein, said disc having a plurality wings separated by a plurality recesses for receiving a coin from said coin supply tube in each recess, said bottom plate having a discharge opening for coins, the diameter of which is less than a predetermined maximum diameter of the coins supplied, characterized in that the discharge opening in the bottom plate is located beneath said coin supply tube, and that the wings of the rotatable disc on the side thereby facing the normal rotational direction forms an edge, having a thickness which essentially corresponds to the thickness of the thinnest occurring coin; a rotational detector connected with and rotatable in sequence with the rotatable disc, said rotation detector, when a stop of the normal rotational direction of said rotatable disc has occurred, emitting a control signal to a drive motor for driving the rotatable disc in a reverse rotational direction for a predetermined duration of time, and then said rotational detector emitting a further control signal to said drive motor to return the rotation of said rotatable disc to the normal rotational direction.

* * * * *